US007854571B1

(12) United States Patent
Evarts

(10) Patent No.: US 7,854,571 B1
(45) Date of Patent: Dec. 21, 2010

(54) SYSTEMS AND METHODS FOR HANDLING PILES

(75) Inventor: Kingsley S. Evarts, Pittsburgh, PA (US)

(73) Assignee: American Piledriving Equipment, Inc., Kent, WA (US)

( * ) Notice: Subject to any disclaimer, the term of this patent is extended or adjusted under 35 U.S.C. 154(b) by 0 days.

(21) Appl. No.: 11/490,399

(22) Filed: Jul. 20, 2006

Related U.S. Application Data

(60) Provisional application No. 60/700,768, filed on Jul. 20, 2005.

(51) Int. Cl.
*E21D 7/00* (2006.01)

(52) U.S. Cl. ..... 405/232; 405/231; 405/274

(58) Field of Classification Search ..... 405/231, 405/232, 272–281
See application file for complete search history.

(56) References Cited

U.S. PATENT DOCUMENTS

| | | | |
|---|---|---|---|
| 48,515 | A | 7/1865 | Campbell et al. |
| 400,209 | A | 3/1889 | Haskins |
| 628,962 | A | 7/1899 | Speer |
| 999,334 | A | 8/1911 | Pearson |
| 1,213,800 | A | 1/1917 | Piper |
| 1,288,989 | A | 12/1918 | Rees |
| 1,294,154 | A | 2/1919 | Payne |
| 1,322,470 | A | 11/1919 | Schenk |
| 1,464,231 | A | 8/1923 | Yezek |
| 1,654,093 | A | 12/1927 | Reid |
| 1,702,349 | A | 2/1929 | Krell |
| 1,762,037 | A | 6/1930 | Taylor |
| 1,787,000 | A | 12/1930 | Hunt |
| 1,903,555 | A | 4/1933 | Robertson |
| 2,068,045 | A | 1/1937 | Wohlmeyer |

(Continued)

FOREIGN PATENT DOCUMENTS

| | | |
|---|---|---|
| DE | 4010357 | 10/1990 |

(Continued)

OTHER PUBLICATIONS

A series of photographs identified by Reference Nos. APE01147-APE01159, undated, 13 pages.

(Continued)

*Primary Examiner*—David J Bagnell
*Assistant Examiner*—Sean D Andrish
(74) *Attorney, Agent, or Firm*—Michael R. Schacht; Schacht Law Office, Inc.

(57) ABSTRACT

A pile driving system comprising an engaging system comprising a suspension system, a vibratory system, and first and second clamp assemblies. The primary housing is operatively supported by an arm assembly of a support system. The suspension system is configured to resiliently oppose movement of a secondary housing within a limited range of movement relative to a primary housing. The vibratory system is rigidly connected to the secondary housing. The first and second clamp to assemblies are supported by the secondary housing. In a first mode, the first clamp assembly rigidly connects the secondary housing to the pile, and in a second mode the second clamp assembly rigidly connects the secondary housing to the pile. The pile driving system drives the pile using a driving force generated by the support system and/or a vibrational force generated by the vibratory system.

14 Claims, 11 Drawing Sheets

U.S. PATENT DOCUMENTS

| | | | |
|---|---|---|---|
| 2,239,024 | A | 4/1941 | Vance |
| 2,577,252 | A | 12/1951 | Kjellman |
| 2,952,132 | A | 9/1960 | Urban |
| 3,004,389 | A | 10/1961 | Muller |
| 3,106,258 | A | 10/1963 | Muller |
| 3,115,198 | A | 12/1963 | Kuss |
| 3,149,851 | A | 9/1964 | Adams |
| 3,172,485 | A | 3/1965 | Spannhake et al. |
| 3,177,029 | A | 4/1965 | Larson |
| 3,193,026 | A | 7/1965 | Kupka |
| 3,227,483 | A | 1/1966 | Guild et al. |
| 3,243,190 | A | 3/1966 | Peregrine |
| 3,289,774 | A | 12/1966 | Bodine, Jr. |
| 3,300,987 | A | 1/1967 | Maeda |
| 3,313,376 | A | 4/1967 | Holland, Sr. |
| 3,371,727 | A | 3/1968 | Belousov et al. |
| 3,381,422 | A | 5/1968 | Olson |
| 3,391,435 | A | 7/1968 | Lebelle |
| 3,394,766 | A | 7/1968 | Lebelle |
| 3,412,813 | A | 11/1968 | Johnson |
| 3,460,637 | A | 8/1969 | Schulin |
| 3,513,587 | A | 5/1970 | Fischer |
| 3,530,947 | A | 9/1970 | Gendron et al. |
| 3,577,645 | A | 5/1971 | Zurawski |
| 3,583,497 | A | 6/1971 | Kossowski et al. |
| 3,620,137 | A | 11/1971 | Prasse |
| 3,679,005 | A | 7/1972 | Inaba et al. |
| 3,684,037 | A | 8/1972 | Bodine |
| 3,686,877 | A | 8/1972 | Bodin |
| 3,711,161 | A | 1/1973 | Proctor et al. |
| 3,734,209 | A | 5/1973 | Haisch et al. |
| 3,786,874 | A | 1/1974 | Jodet et al. |
| 3,797,585 | A | 3/1974 | Ludvigson |
| 3,822,969 | A | 7/1974 | Kummel |
| 3,828,864 | A | 8/1974 | Haverkamp et al. |
| 3,865,501 | A | 2/1975 | Kniep |
| 3,871,617 | A | 3/1975 | Majima |
| 3,874,244 | A | 4/1975 | Rasmussen et al. |
| 3,891,186 | A | 6/1975 | Thorsell |
| 3,907,042 | A | 9/1975 | Halwas et al. |
| 3,952,796 | A | 4/1976 | Larson |
| 3,959,557 | A | 5/1976 | Berry |
| 3,967,688 | A | 7/1976 | Inenaga et al. |
| 3,975,918 | A | 8/1976 | Jansz |
| 3,998,063 | A | 12/1976 | Harders |
| 4,018,290 | A | 4/1977 | Schmidt |
| 4,033,419 | A | 7/1977 | Pennington |
| 4,067,369 | A | 1/1978 | Harmon |
| 4,076,081 | A | 2/1978 | Schnell |
| 4,082,361 | A | 4/1978 | Lanfermann |
| 4,099,387 | A | 7/1978 | Frederick et al. |
| 4,100,974 | A | 7/1978 | Pepe |
| 4,109,475 | A | 8/1978 | Schnell |
| 4,113,034 | A | 9/1978 | Carlson |
| 4,119,159 | A | 10/1978 | Arentsen |
| 4,143,985 | A | 3/1979 | Axelsson et al. |
| 4,154,307 | A | 5/1979 | Gendron et al. |
| 4,155,600 | A | 5/1979 | Lanfermann et al. |
| 4,166,508 | A | 9/1979 | van den Berg |
| 4,180,047 | A | 12/1979 | Bertelson |
| 4,195,698 | A | 4/1980 | Nakagawasai |
| 4,248,550 | A | 2/1981 | Blaschke et al. |
| 4,274,761 | A | 6/1981 | Boguth |
| 4,312,413 | A | 1/1982 | Loftis |
| 4,362,216 | A | 12/1982 | Jansz |
| 4,375,927 | A | 3/1983 | Kniep |
| 4,397,199 | A | 8/1983 | Jahn |
| 4,428,699 | A | 1/1984 | Juhoia |
| 4,455,105 | A | 6/1984 | Juhoia |
| 4,497,376 | A | 2/1985 | Kurylko |
| 4,505,614 | A | 3/1985 | Anschutz |
| 4,519,729 | A | 5/1985 | Clarke, Jr. et al. |
| 4,537,527 | A | 8/1985 | Juhola et al. |
| 4,547,110 | A | 10/1985 | Davidson |
| 4,553,443 | A | 11/1985 | Rossfelder et al. |
| 4,601,615 | A | 7/1986 | Cavalli |
| 4,603,748 | A | 8/1986 | Rossfelder et al. |
| 4,627,768 | A | 12/1986 | Thomas et al. |
| 4,632,602 | A | 12/1986 | Hovnanian |
| 4,637,475 | A | 1/1987 | England et al. |
| 4,645,017 | A | 2/1987 | Bodine |
| 4,735,270 | A | 4/1988 | Fenyvesi |
| 4,755,080 | A | 7/1988 | Cortlever et al. |
| 4,758,148 | A | 7/1988 | Jidell |
| 4,768,900 | A | 9/1988 | Burland |
| 4,799,557 | A | 1/1989 | Jacquemet |
| 4,813,814 | A | 3/1989 | Shibuta et al. |
| 4,844,661 | A | 7/1989 | Martin et al. |
| 4,863,312 | A | 9/1989 | Cavalli |
| 4,915,180 | A | 4/1990 | Schisler |
| 4,993,500 | A | 2/1991 | Greene et al. |
| 5,004,055 | A | 4/1991 | Porritt et al. |
| 5,076,090 | A | 12/1991 | Cetnarowski |
| 5,088,565 | A | 2/1992 | Evarts |
| 5,117,925 | A | 6/1992 | White |
| 5,154,667 | A | 10/1992 | Mauch et al. |
| 5,213,449 | A | 5/1993 | Morris |
| 5,253,542 | A | 10/1993 | Houze |
| RE34,460 | E | 11/1993 | Ishiguro et al. |
| 5,263,544 | A | 11/1993 | White |
| 5,281,775 | A | 1/1994 | Gremillion |
| 5,343,002 | A | 8/1994 | Gremillion |
| 5,355,964 | A | 10/1994 | White |
| 5,375,897 | A | 12/1994 | Gazel-Anthoine |
| 5,410,879 | A | 5/1995 | Houze |
| 5,439,326 | A | 8/1995 | Goughnour et al. |
| 5,540,295 | A | 7/1996 | Serrette |
| 5,544,979 | A | 8/1996 | White |
| 5,549,168 | A | 8/1996 | Sadler et al. |
| 5,562,169 | A | 10/1996 | Barrow |
| 5,609,380 | A | 3/1997 | White |
| 5,653,556 | A | 8/1997 | White |
| 5,658,091 | A | 8/1997 | Goughnour et al. |
| 5,727,639 | A | 3/1998 | Jeter |
| 5,794,716 | A | 8/1998 | White |
| 5,811,741 | A | 9/1998 | Coast et al. |
| 5,860,482 | A | 1/1999 | Gremillion et al. |
| 6,003,619 | A | 12/1999 | Lange |
| 6,039,508 | A | 3/2000 | White |
| 6,102,133 | A | 8/2000 | Scheid et al. |
| 6,129,159 | A | 10/2000 | Scott et al. |
| 6,179,527 | B1 | 1/2001 | Goughnour |
| 6,216,394 | B1 | 4/2001 | Fenelon |
| 6,234,260 | B1 | 5/2001 | Coast et al. |
| 6,250,426 | B1 | 6/2001 | Lombard |
| 6,360,829 | B1 | 3/2002 | Naber et al. |
| 6,386,295 | B1 | 5/2002 | Suver |
| 6,427,402 | B1 | 8/2002 | White |
| 6,431,795 | B2 | 8/2002 | White |
| 6,447,036 | B1 | 9/2002 | White |
| 6,543,966 | B2 | 4/2003 | White |
| 6,557,647 | B2 | 5/2003 | White |
| 6,582,158 | B1 | 6/2003 | Van Stein |
| 6,648,556 | B1 * | 11/2003 | White ..... 405/249 |
| 6,672,805 | B1 | 1/2004 | White |
| 6,691,797 | B1 * | 2/2004 | Hart ..... 173/49 |
| 6,732,483 | B1 | 5/2004 | White |
| 6,736,218 | B1 | 5/2004 | White |
| 6,752,043 | B2 | 6/2004 | Carlson |
| 6,860,338 | B2 | 3/2005 | Salesse et al. |
| 6,896,448 | B1 | 5/2005 | White |
| 6,908,262 | B1 * | 6/2005 | White ..... 405/232 |
| 6,942,430 | B1 | 9/2005 | Suver |
| 6,988,564 | B2 | 1/2006 | White |

| | | | |
|---|---|---|---|
| 7,168,890 | B1 | 1/2007 | Evarts |
| 7,392,855 | B1 | 7/2008 | White |
| 2006/0113456 | A1 | 6/2006 | Miller |

FOREIGN PATENT DOCUMENTS

| | | |
|---|---|---|
| EP | 0172960 | 5/1986 |
| EP | 362158 | 4/1990 |
| EP | 526743 | 10/1993 |
| FR | 838717 | 3/1939 |
| FR | 2560247 | 8/1985 |
| GB | 1066727 | 4/1967 |
| GB | 2003769 | 3/1979 |
| GB | 2023496 | 1/1980 |
| GB | 2043755 | 10/1980 |
| GB | 2060742 | 5/1981 |
| GB | 2028902 | 8/1982 |
| JP | 5494703 | 7/1979 |
| JP | 355098526 | 7/1980 |
| JP | 356034828 | 4/1981 |
| JP | 57169130 | 10/1982 |
| JP | 59228529 | 12/1984 |
| JP | 61221416 | 10/1986 |
| JP | 0258627 | 2/1990 |
| JP | 497015 | 3/1992 |
| JP | 473035 | 6/1992 |
| JP | 5246681 | 9/1993 |
| JP | 6136751 | 5/1994 |
| KR | 9216944 | 9/1992 |
| NL | 42349 | 1/1938 |
| NL | 65252 | 2/1950 |
| NL | 7710385 | 3/1978 |
| NL | 7707303 | 1/1979 |
| NL | 7805153 | 11/1979 |
| NO | 46428 | 4/1929 |
| SU | 1027357 | 7/1983 |
| WO | 8707673 | 12/1987 |
| WO | 8805843 | 8/1988 |

OTHER PUBLICATIONS

APE, "APE Model 8 Hydraulic Impact Hammer", undated, 1 page.
Japan Development Consultants, Inc., Japanese language brochure entitled "Castle Board Drain Method" identified by Reference Nos. APE00857-APE00863, Aug. 1976, 7 pages.
International Construction Equipment, Inc., "Diesel Pile Hammers" brochure identified by Ref. No. DH4-1288-5C, undated, 6 pages.
International Construction Equipment, Inc., "Hydraulic Vibratory Driver/Extractors For Piling and Caisson Work", undated, 10 pages.
International Construction Equipment, Inc., "Hydraulic Vibratory Driver/Extractors For Piling and Caisson Work" brochure identified by Ref. No. V7-0890-51, undated, 3 pages.
"Kony Drain Board", undated, 1 page.
Korean language documents identified by Ref. Nos. APE00864-APE00891, dates from 1982-1997, 28 pages.
www.mmsonline.com/columns/micro-keying-keeps-a-better-grip.aspx, Seibert, Stan, Modern Machine Shop: "Micro-Keying Keeps A Better Grip", Aug. 1, 1999, 2 pages.
MKT Geotechnical Systems, Manual No. 01807: "Operating, Maintenance and Parts Manual for MS350 and MS500 Single-Acting Pile Hammers", undated, 12 pages.
A Report identifying systems for driving mandrels carrying wick drain material into the earth, identified by Ref. Nos. APE0510-APE0536, undated, 27 pages.
Schematic drawings identified by Ref. Nos. APE01038, APE01039, APE0339, undated, 3 pages.
Shanghai Jintai SEMW, undated, 8 pages.
"The 1st Report on The Treatment of Soft Foundation in Juck Hyun Industrial Site" identified by Ref. Nos. APE00854-APE00856, 1976, 3 pages.

* cited by examiner

SYSTEMS AND METHODS FOR HANDLING PILES

RELATED APPLICATIONS

This application claims priority of U.S. Provisional Patent Application Ser. No. 60/700,768 filed Jul. 20, 2005, the contents of which are incorporated herein by reference.

FIELD OF THE INVENTION

The present invention relates to pile handling systems and methods and, more specifically, to pile handling systems and methods that allow piles to be gripped from the side or the top and which use a combination of driving and vibratory forces to drive the pile.

BACKGROUND OF THE INVENTION

Modern construction design often requires piles to be driven into the earth at desired locations. In the context of the present invention, the term "pile" will be used to refer to a rigid, elongate member capable of being driven into the earth. Piles may take many forms and are normally used as part of the footing for a structural element such as a building foundation or bridge pier, but piles may be used for many reasons, and the end use of the pile is not a part of the present invention.

The term "drive" as used herein refers to the application of a force along a longitudinal axis of the pile either to force the pile into the earth or to extract the pile from the earth. The terms "handle" or "handling" as used herein refer both to the driving of a pile into the earth and to the movement of pile prior to driving.

The present invention is of particular significance when the pile takes the form of a steel H-beam, and that application will be described herein in detail. However, the principles of the present invention may be applied to other pile configurations, such as cylindrical piles (e.g., wooden piles, pipe piles, caissons, etc.) and/or sheet piles.

Pile handling systems that use vibratory loads in combination with driving loads are highly effective at forcing piles into or extracting piles from the earth. The vibratory forces of such vibratory pile driving systems are transmitted to the pile to be driven by a clamping assembly. The to clamping assembly ensures that the vibratory forces in both directions are applied to the pile to be driven.

Conventional clamping assemblies engage an end of the pile such that the driving and vibratory forces are applied along an axis of the pile. Some specialized pile handling systems employ clamping assemblies that are adapted to grip a side of the pile. Other specialized pile handling systems employ clamping assemblies that are adapted to grip either a side or an end of the pile. The ability to grab either the side or the end of a pile facilitates both moving of the pile prior to driving and driving of the pile without the use of additional equipment. The present invention relates to pile handling systems having clamping assemblies that are adapted to grip either the side or the end of the pile.

The need exists for improved pile handling systems capable of gripping a pile from either the side or the top and driving the pile with a combination of driving and vibration forces.

SUMMARY OF THE INVENTION

A pile driving system comprising an engaging system comprising a suspension system, a vibratory system, and first and second clamp assemblies. The primary housing is operatively supported by an arm assembly of a support system. The suspension system is configured to resiliently oppose movement of a secondary housing within a limited range of movement relative to a primary housing. The vibratory system is rigidly connected to the secondary housing. The first and second clamp assemblies are supported by the secondary housing. In a first mode, the first clamp assembly rigidly connects the secondary housing to the pile, and in a second mode the second clamp assembly rigidly connects the secondary housing to the pile. The pile driving system drives the pile using a driving force generated by the support system and/or a vibrational to force generated by the vibratory system.

DETAILED DESCRIPTION OF THE INVENTION

Figure 1:
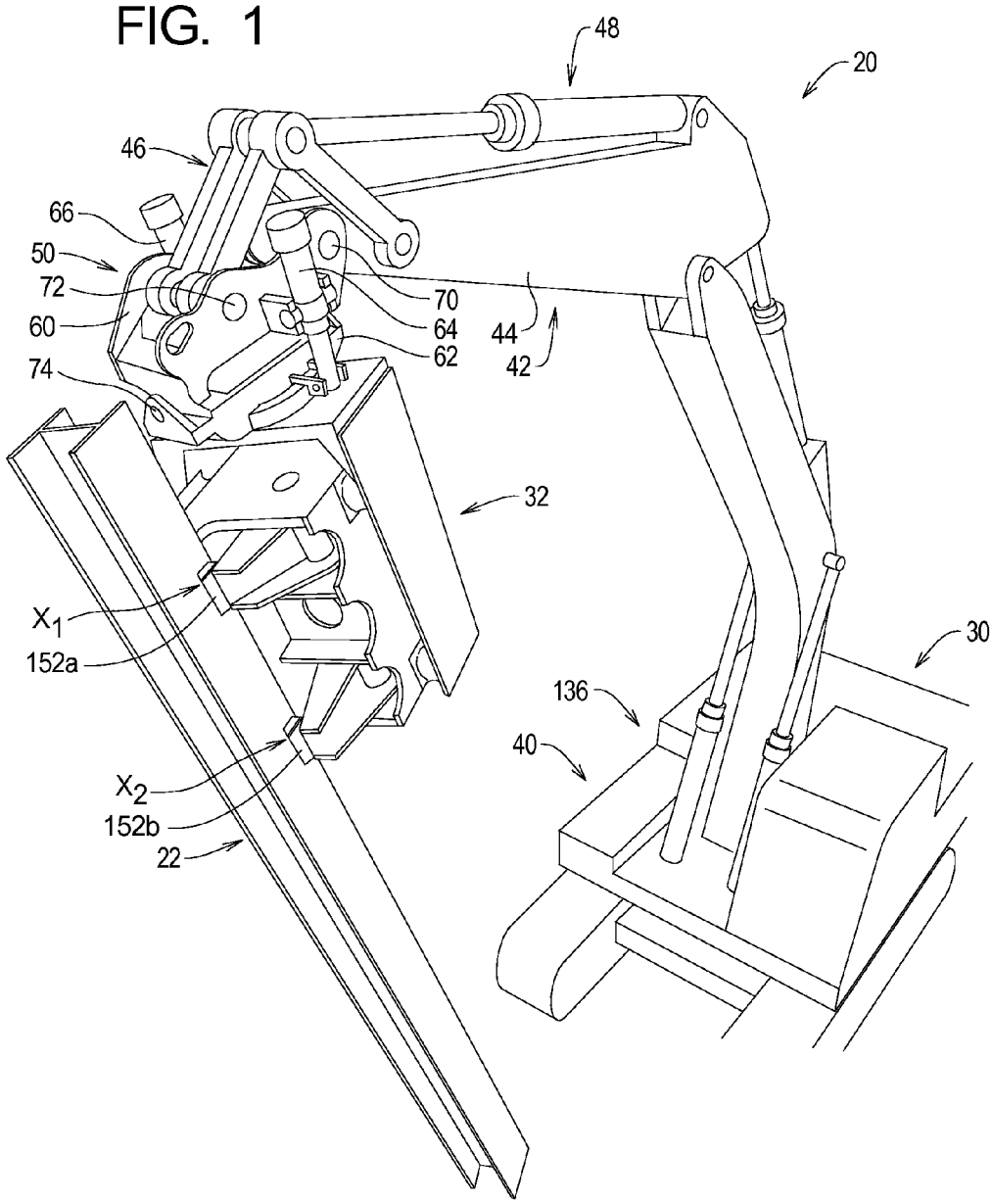
FIG. 1 is a perspective view depicting a pile handling system constructed in accordance with the present invention being used to drive a pile.
Figure 2:
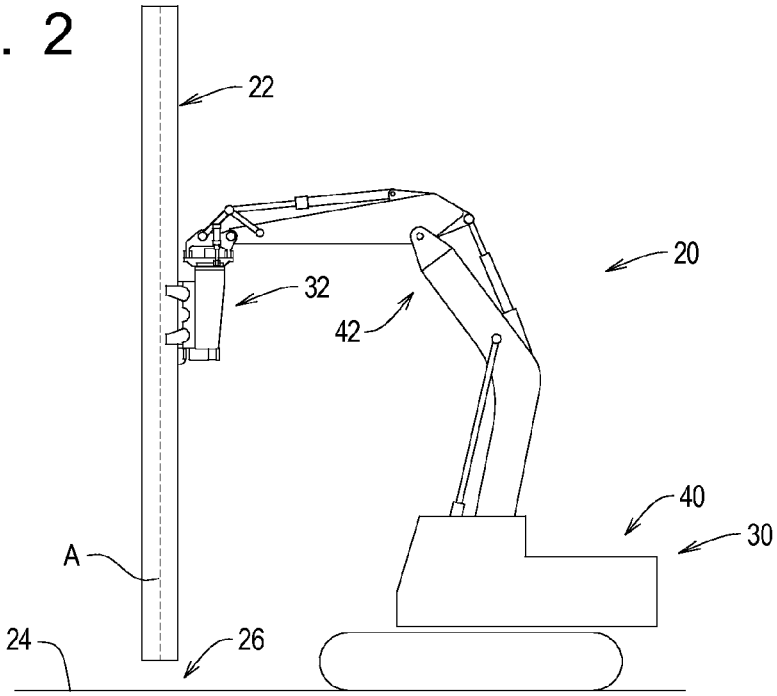
FIGS. 2 and 3 are side elevation views of the pile handling system depicted in FIG. 1 being used in a first orientation to drive a pile.
Figure 3:
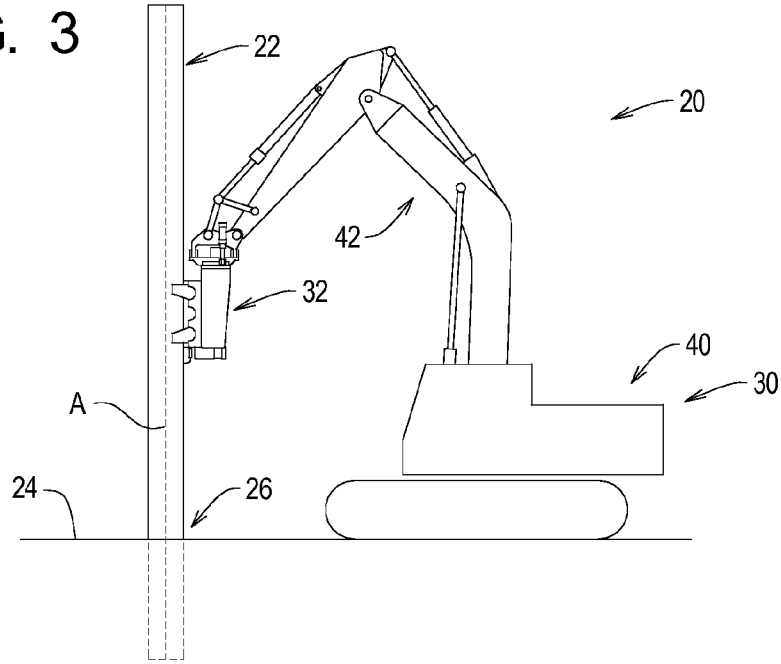

Referring initially to FIG. 1 of the drawings, depicted at 20 therein is a pile handling system constructed in accordance with, and embodying, the principles of the present invention. In FIGS. 2 and 3, the pile handling system 20 is shown driving a pile 22 into the ground 24 at a desired location 26. The example pile 22 is an H-beam that defines a pile axis A as shown in FIGS. 2-5 of the drawings. Although FIGS. 1-3 illustrate the pile handling system 20 driving an example pile that takes the form of an H beam, the pile handling system 20 may be used to handle and drive sheet piles such as the sheet piles 28 depicted in FIG. 15 of the drawings.

The pile handling system 20 comprises a support system 30 and a main assembly 32. The support system 30 is or may be conventional and will be described herein only to the extent necessary for a complete understanding of the present invention. As shown in FIG. 1, the support system 30 comprises a vehicle 40 from which an arm assembly 42 extends. The arm assembly 42 comprises a distal arm member 44, a linkage assembly 46, and a distal arm actuator assembly 48.

The main assembly 32 comprises a coupling assembly 50 and an engaging system 52. The coupling assembly 50 is adapted to allow the engaging system 52 to be attached to the support system 30. In particular, the coupling assembly 50 comprises a yoke member 60, a coupler mount 62, and first and second lateral actuator assemblies 64 and 66. The yoke member 60 is connected to the distal arm member 44 by an arm pin 70 and to the linkage assembly 46 by a linkage pin 72.

Figure 4:
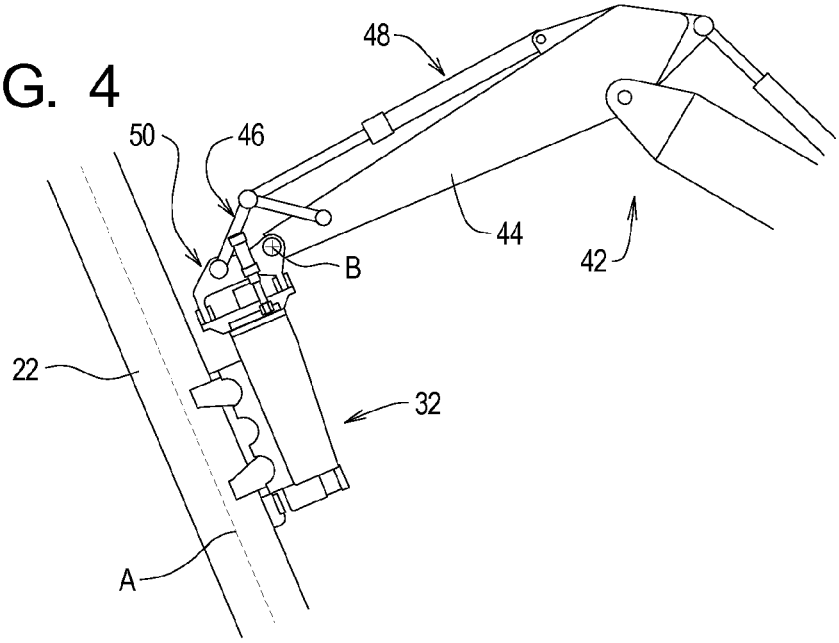
FIGS. 4 and 5 are side elevation views of a portion of the pile handling system of FIG. 1 illustrating a first axis of rotation.
Figure 5:
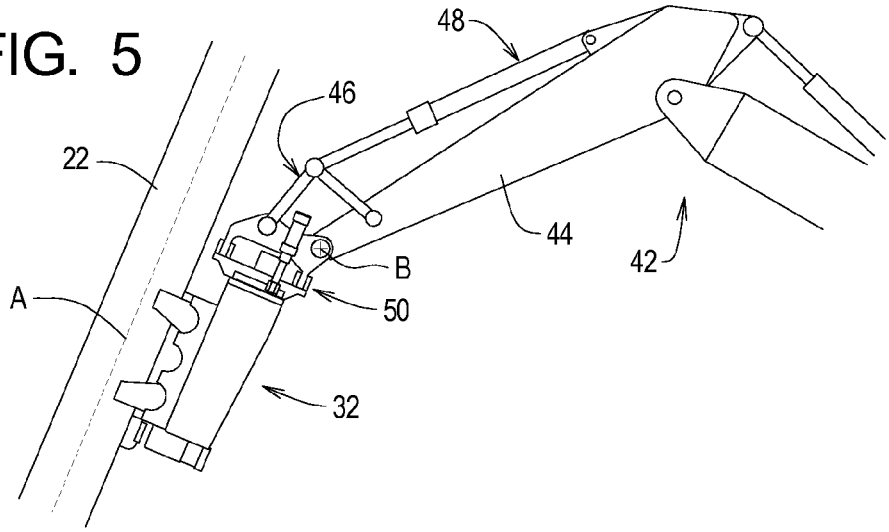

As shown in FIGS. 4 and 5, operation of the distal arm actuator assembly 48 causes the main assembly 32 to rotate about a first axis B. When attached to the pile 22, the main assembly 32 thus allows the axis A of the pile 22 to be tilted forward and backward within a plane defined by the arm assembly 42 of the support system 30.

Figure 6:
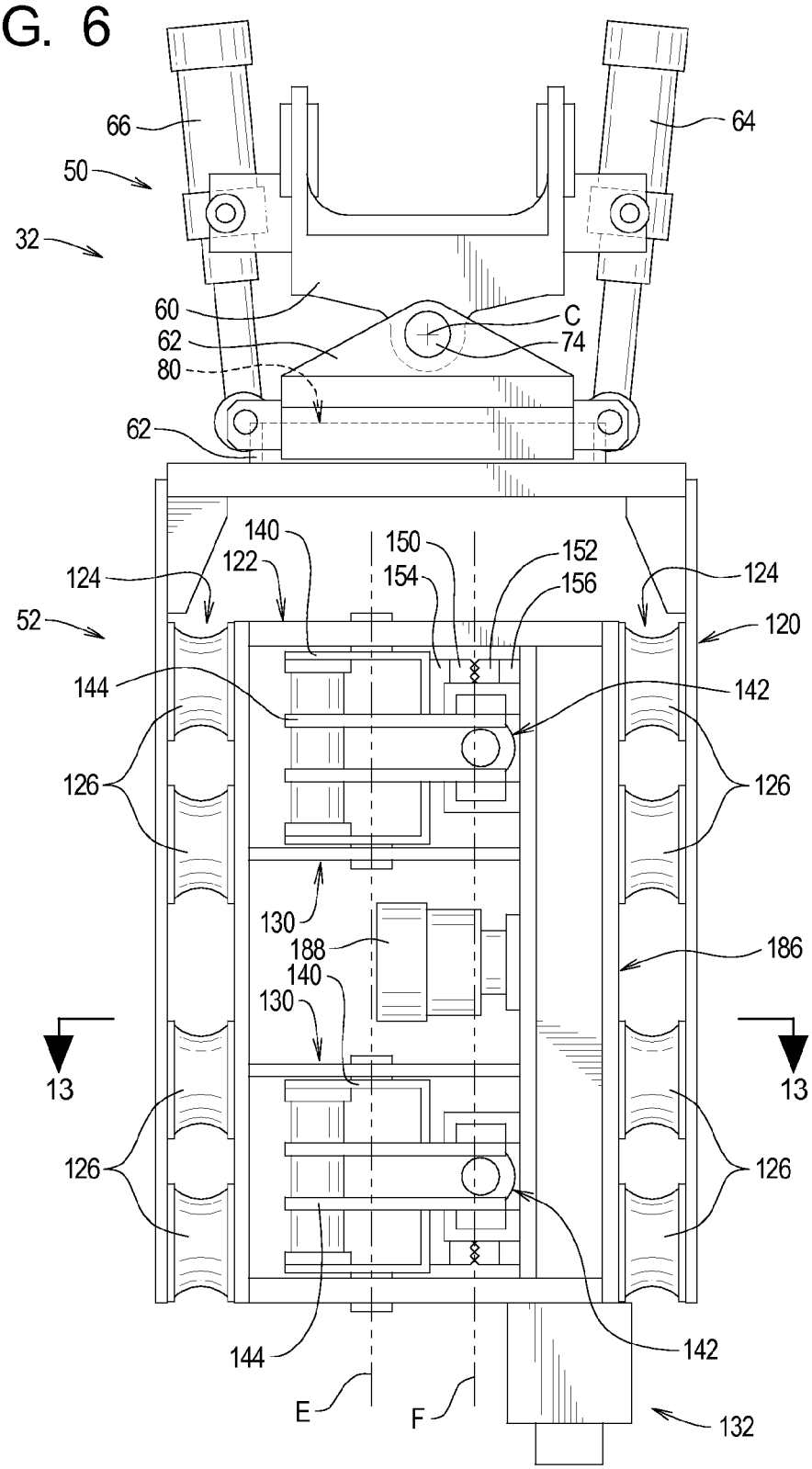
FIG. 6 is a top plan view illustrating a driving assembly of the pile handling system of FIG. 1.
Figure 9:
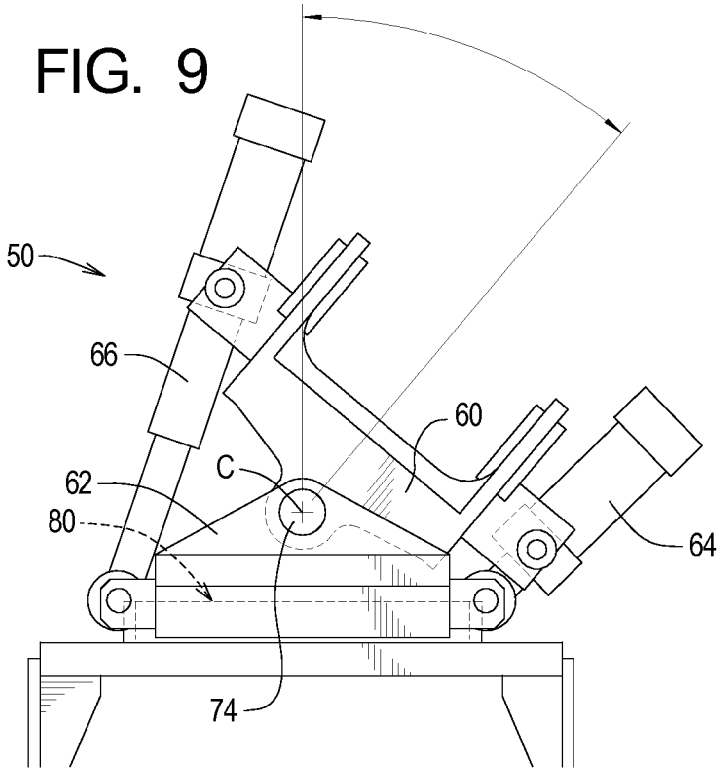
FIG. 9 is a top plan view depicting a second axis of rotation of the pile handling system of FIG. 1.

Referring now to FIG. 6, this figure shows that the yoke member 60 is connected to the coupler mount 62 by a coupler pin 74 that defines a second axis C. The first and second lateral actuator assemblies 64 and 66 are connected between the yoke member 60 and the coupler mount 62 such that lengthening of one of the lateral actuator assemblies and shortening of the other lateral actuator assemblies forces the coupler mount 62 to rotate relative to the yoke member 60 as shown in FIG. 9. The connection of the yoke member 60 to the coupler mount 62 allows the coupler mount 62, and thus the main assembly 32, to be rotated about the second axis C relative to the yoke member 60.

Referring now to FIGS. 6-8, 11, and 12, depicted therein is a coupler bearing assembly 80 and a rotation actuator 82. The coupler bearing assembly 80 engages the coupler mount 62 for rotation about a third axis D. The coupler bearing assembly 80 is or may be conventional and is sized and dimensioned to rotatably support the weight of the main assembly 32 and pile 22. When the rotation actuator 82 is rotated, the main assembly 32 rotates about the third axis D relative to the coupler mount 62.

The coupling assembly 50 thus attaches the engaging system 52 to the arm assembly 42 such that the engaging system 52 may be displaced in many different positions relative to the vehicle 40 in addition to those positions allowed by the conventional arm assembly 42 of the support system 30.

Figure 7:
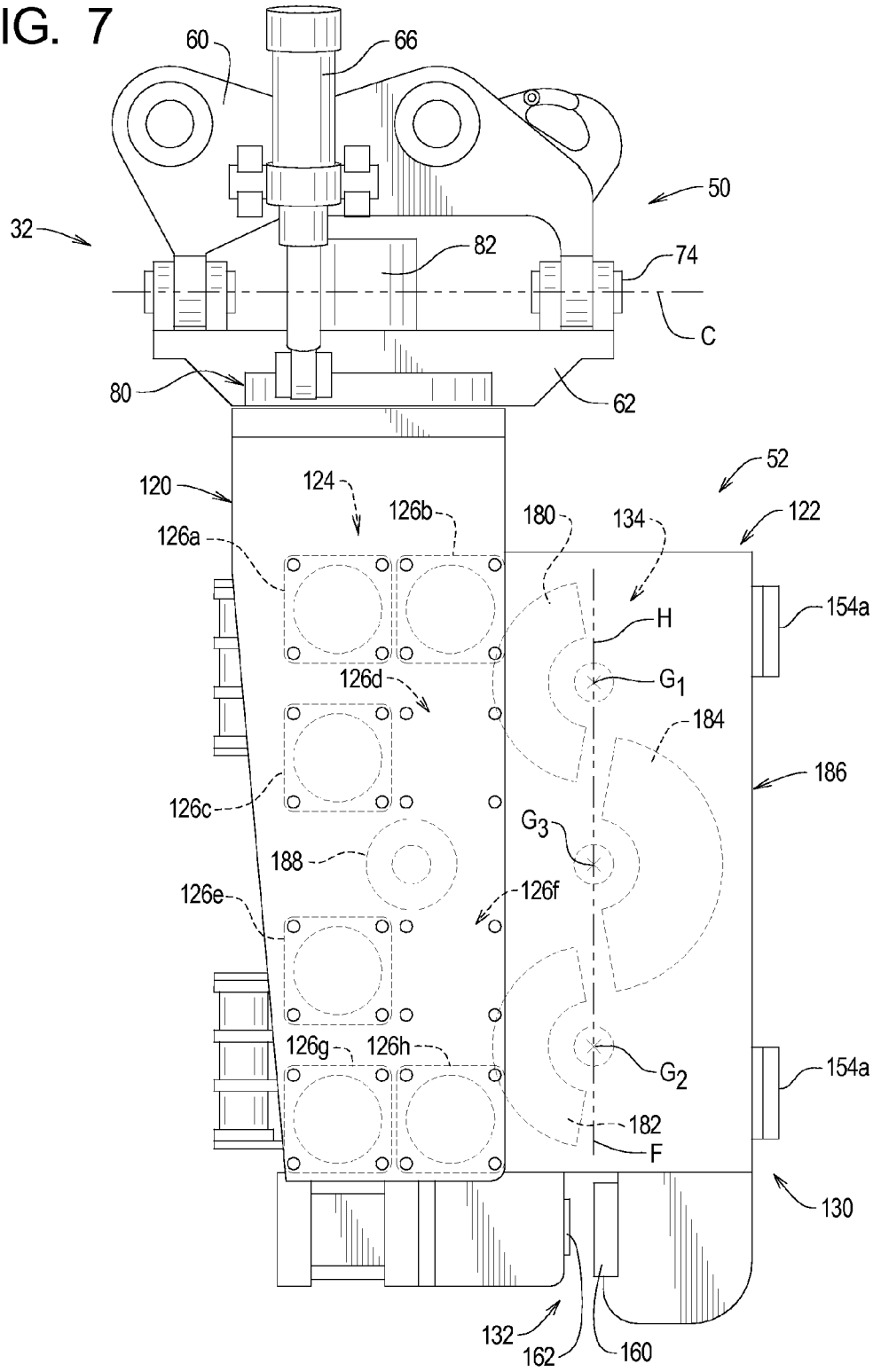
FIGS. 7 and 8 are right and left side elevation views, respectively, of the driving assembly of FIG. 6.
Figure 8:
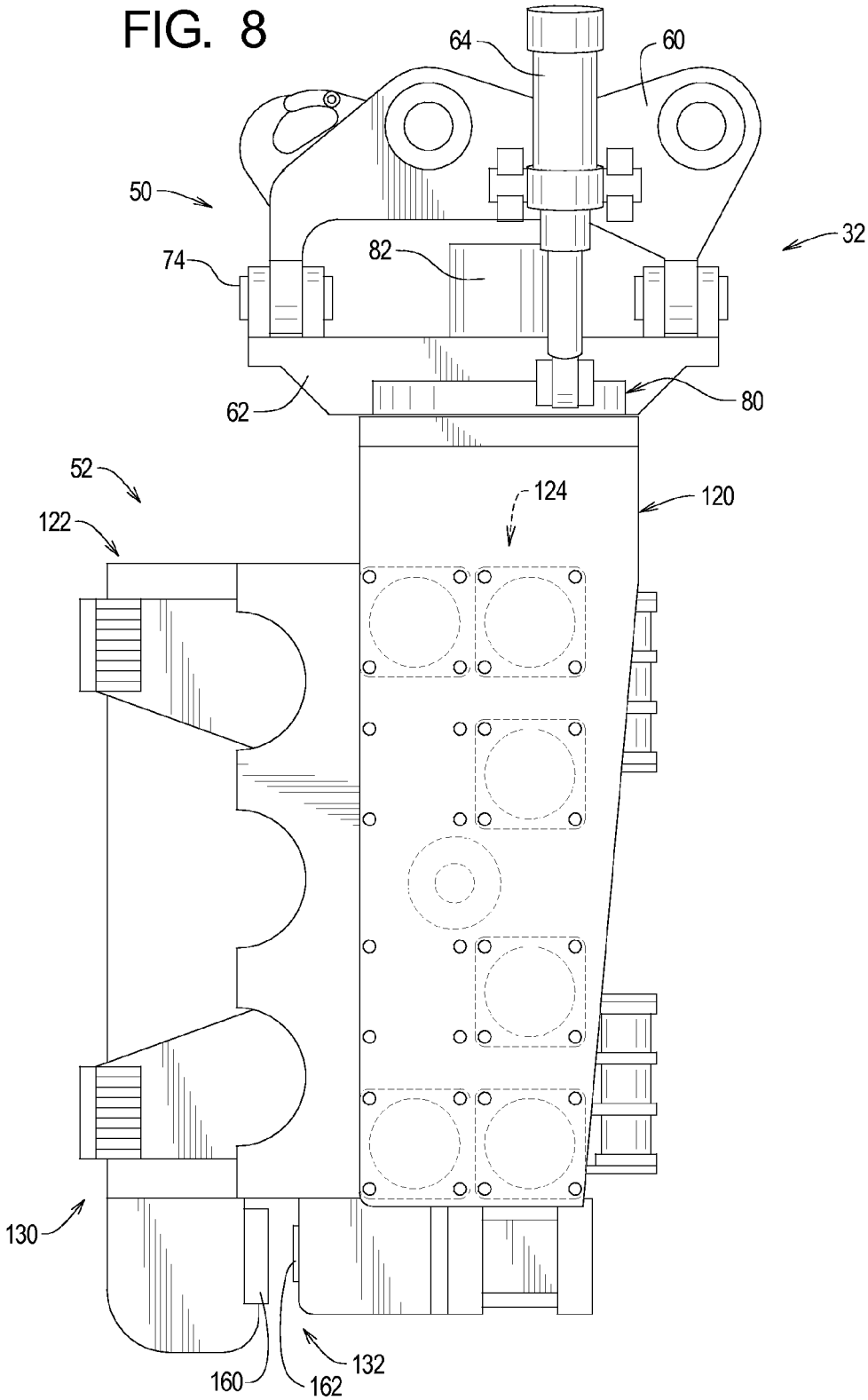

Referring now for a moment back to FIGS. 6-8, those figures illustrate that the engaging system 52 of the main assembly 32 comprises a primary housing 120 and a secondary housing 122. The primary housing 120 is rigidly connected to the coupler bearing assembly 80 such that the primary housing 120 may be pivoted about the first and second axis B and C and rotated about the third axis D as generally described above. The secondary housing 122 is suspended from the primary housing 120 by a suspension system 124 comprising a plurality of elastomeric members 126.

While the secondary housing 122 generally moves with the primary housing 120 relative to the axis B, C, and D, the suspension system 124 allows the secondary housing 122 to move within a limited range of movement relative to the primary housing 120. In particular, the elastomeric members resiliently oppose movement of the secondary housing 122 relative to the primary housing 120. As will be described in further detail below, the secondary housing 122 vibrates during normal operation of the engaging system 52, and the suspension system 124 inhibits transmission of these vibrations to the primary housing 120 and thus the support system 30 connected thereto.

As perhaps best shown in FIG. 7, the example main assembly 32 defines eight attachment locations **126*a*-126*h* where the elastomeric members 126 connect the primary housing 120 to one side of the secondary housing 122. Another eight attachment locations are formed between the primary housing 120 and the other side of the secondary housing 122 as illustrated in FIG. 8**.

FIGS. 7 and 8 illustrate that the example main assembly 32 is configured to comprise six elastomeric members on each side of the secondary housing 122 for a total of 12 elastomeric members. Referring for a moment back FIG. 7, it can be seen that the six elastomeric members shown therein are located at the attachment locations **126*a*, 126*b*, 126*c*, 126*e*, 126*g*, and 126*h*, with the attachment locations 126*d* and 126*f* being empty. The six elastomeric members on the other side of the secondary housing 122** similarly occupy six out of eight of the attachment locations on that other side.

The number of elastomeric members 126 determines the amount of shock absorption provided by the suspension system 124. In the example main assembly 32 depicted in FIGS. 7 and 8, the twelve elastomeric members provide suspension tuned for a particular pile configuration and soil conditions. With the different pile configurations and/or soil conditions, fewer than twelve or more than twelve elastomeric members 126 may be located at the attachment locations depicted in FIGS. 7 and 8.

As perhaps best shown in FIGS. 7 and 8, the engaging system 52 further comprises a side clamp system 130, a bottom clamp system 132, and a vibrational system 134. The example side clamp system 130, bottom clamp system 132, and vibrational system 134 are hydraulic systems power to which is provided by a hydraulic fluid supply schematically depicted at 136 in FIG. 1. The hydraulic fluid supply is connected to the clamp systems 130 and 132 and vibrational system 134 by hoses (not shown) in a conventional manner. The hydraulic fluid supply is conventionally also connected to the various actuator assemblies described above. The hydraulic fluid supply 136 is or may be conventional and will not be described herein in further detail.

Figure 13:
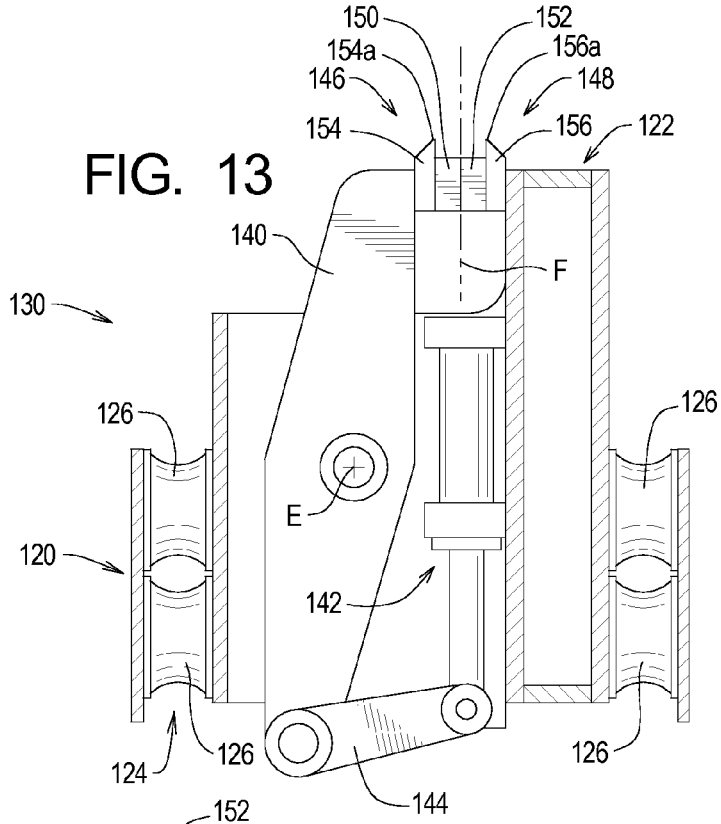
FIGS. 13 and 14 are top plan, sectional views depicting closed and opened configurations, respectively, of a side clamping system of the driving assembly of FIG. 6.
Figure 14:
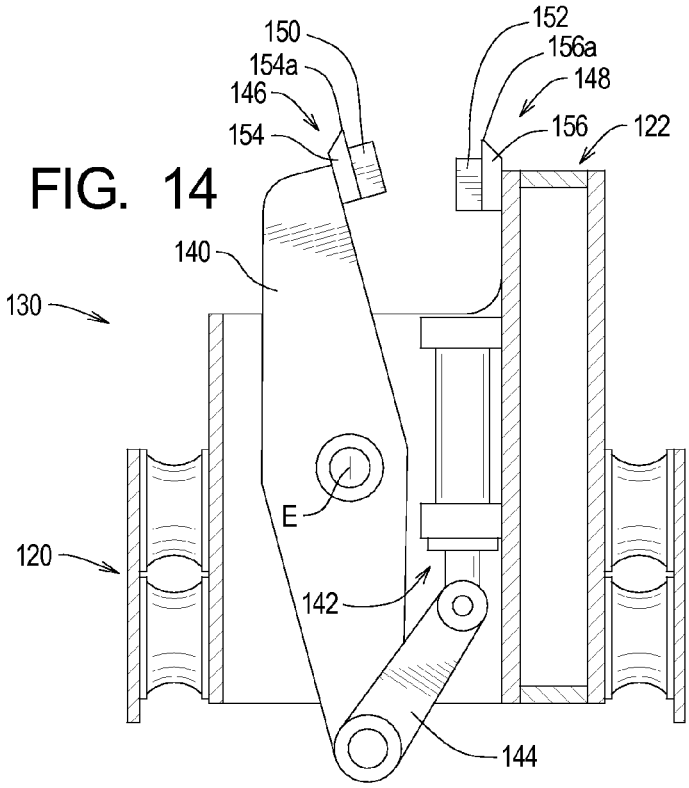

Referring now to FIGS. 6, 13, and 14, the side clamp system 130 will be described in further detail. In particular, FIGS. 13 and 14 illustrate that the side clamp system 130 comprises a clamp arm 140, a side clamp actuator assembly 142, and a link arm 144. The clamp arm 140 is pivotably attached to the secondary housing 122 for rotation about a clamp axis E. The side clamp actuator assembly 142 is rigidly supported by the secondary housing 122. The link arm 144 is connected between the side clamp actuator assembly 142 and the clamp arm 140. As shown in FIGS. 13 and 14, extension or retraction of the side clamp actuator assembly 142 causes movement of the clamp arm 140 between a closed position (FIG. 13) and an open position (FIG. 14).

FIGS. 13 and 14 further illustrate that an arm grip assembly 146 is secured to the clamp arm 140 and a stop grip assembly 148 is attached to the secondary housing 122. When the clamp arm 140 is in its open configuration, a gap exists between the arm grip assembly 146 and stop grip assembly 148. When the clamp arm 140 is in its closed position, the arm grip assembly 146 engages the stop grip assembly 148 to define a first clamp plane $F_1$.

The arm grip assembly 146 comprises a pair of movable grip members **150*a* and 150*b*, while the stop grip assembly 148 comprises a pair of fixed grip members 152*a* and 152*b*. These example grip members 150*a,b* and 152*a,b* are rectangular rigid members adapted to securely grip the pile 22 to transmit both driving and vibratory forces to the pile 22, but other shapes and configurations may be used. The use of different materials, surface treatments, and/or texturing on the surfaces of the grip members 150***a,b* and 152*a,b* can help increase friction between the engaging system 52 and the pile 22. The pairs of grip members 150*a,b* and 152*a,b* defines upper and lower first gripping locations $X_1$ and $X_2$ as shown for example in FIG. 1. The upper and lower first gripping locations $X_1$ and $X_2$ both lie in the first clamp plane $F_1$.

Figure 15:
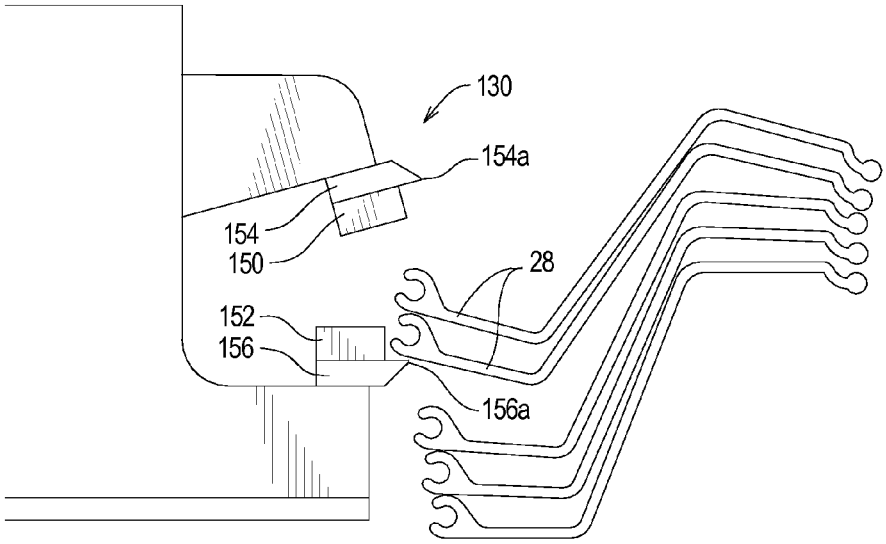
FIG. 15 is a side elevation view depicting the driving assembly of FIG. 6 being used to split nested sheet piles for lifting access.

In addition, the example arm grip assembly 146 comprises a first pick member 154, while the example stop grip assembly 148 comprises a second pick member 156. The pick members 154 and 156 define tip portions 154*a* and 156*a* that can be used to move piles under certain circumstances. The pick members 154 and 156 allow the side clamp system 130 to pick one, two, or more sheet piles from a nested stack of such piles. For example, FIG. 15 shows a stack of sheet piles 28 from which two sheet piles are being separated from a nested stack of piles by inserting the second pick member 156 between the two piles being removed and the remaining piles in the stack. The side clamp system 130 of the present invention thus allows one sheet pile to be removed from the stack to a position where the pile can be gripped using the side clamp system 130 in a conventional manner.

Figure 18:
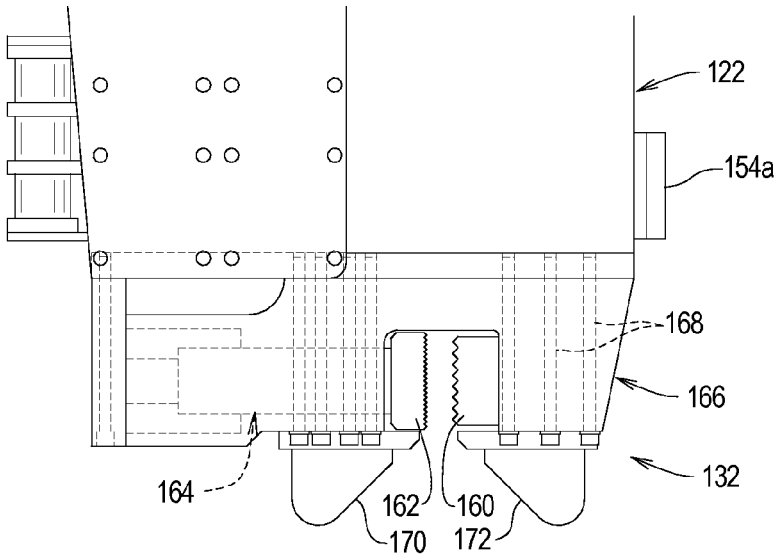
FIGS. 18 and 19 are side elevation views depicting a detachable bottom clamp assembly in attached and detached configurations, respectively, that may be used with the driving assembly of FIG. 6.
Figure 19:
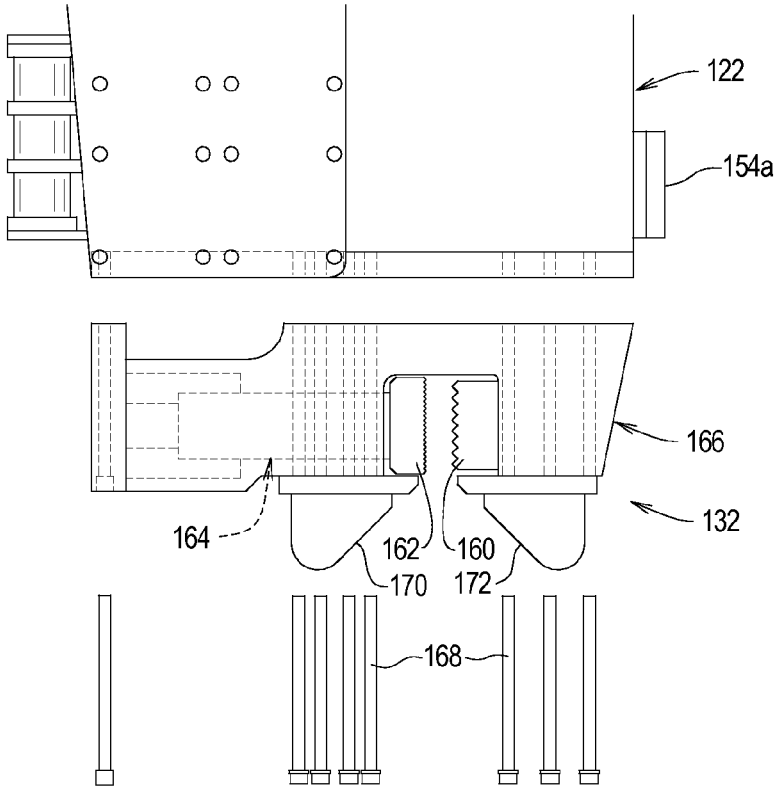

Referring now to FIGS. 18 and 19, the bottom clamp system 132 will now be described in further detail. The bottom clamp system 132 comprises a fixed clamp member 160, a moveable clamp member 162, and a bottom clamp actuator assembly 164. The fixed clamp member 160 is secured relative to the secondary housing 122. The moveable clamp member 162 is mounted on the bottom clamp actuator assembly 164, and the bottom clamp actual assembly 164 is secured relative to the secondary housing 122.

Figure 16:
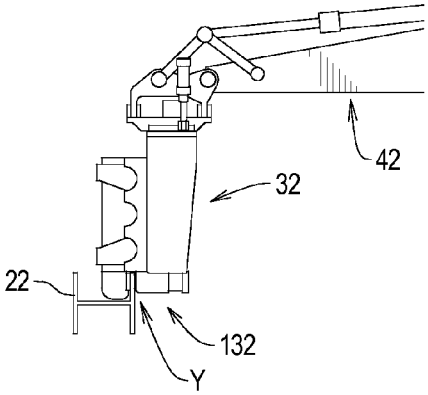
FIGS. 16 and 17 are a side elevation views depicting the use of a bottom clamping system of the driving assembly of FIG. 6 to lift piles in horizontal and vertical orientations, respectively.
Figure 17:
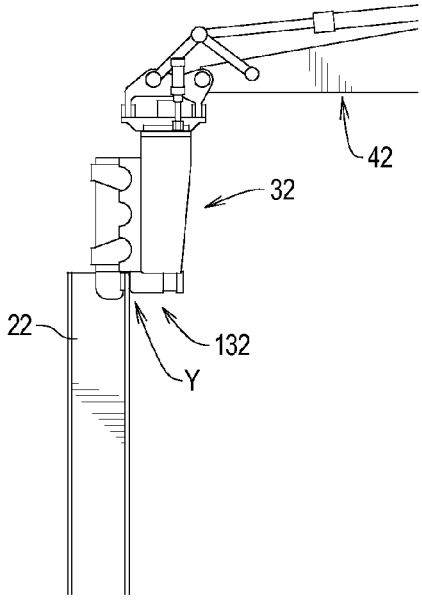

The bottom clamp actuator assembly 164 is configured such that extension thereof causes the moveable clamp member 162 to engage the fixed clamp member 160 in a second clamp plane $F_2$ defined by the fixed clamp member 160. In particular, the clamp members 160 and 162 engage each other at a third gripping location Y. The third gripping location Y lies in the second clamp plane $F_2$. As shown in FIGS. 16 and 17, the pile 22 may thus be gripped by the bottom clamp assembly 132 to move the pile as shown in FIG. 16 and/or to drive the pile 22 as shown in FIG. 17.

Referring back to FIGS. 18 and 19, it can be seen that the example bottom clamp system 132 comprises a bottom clamp housing 166 that is attached to the secondary housing 122 using a plurality of bottom clamp bolts 168. FIGS. 18 and 19 further depict first and second bottom clamp guide surfaces 170 and 172. These guide surfaces 170 and 172 are slanted towards a gap between the fixed and moveable clamp members 160 and 162 to help direct a pile or portion of a pile into this gap.

Figure 10:
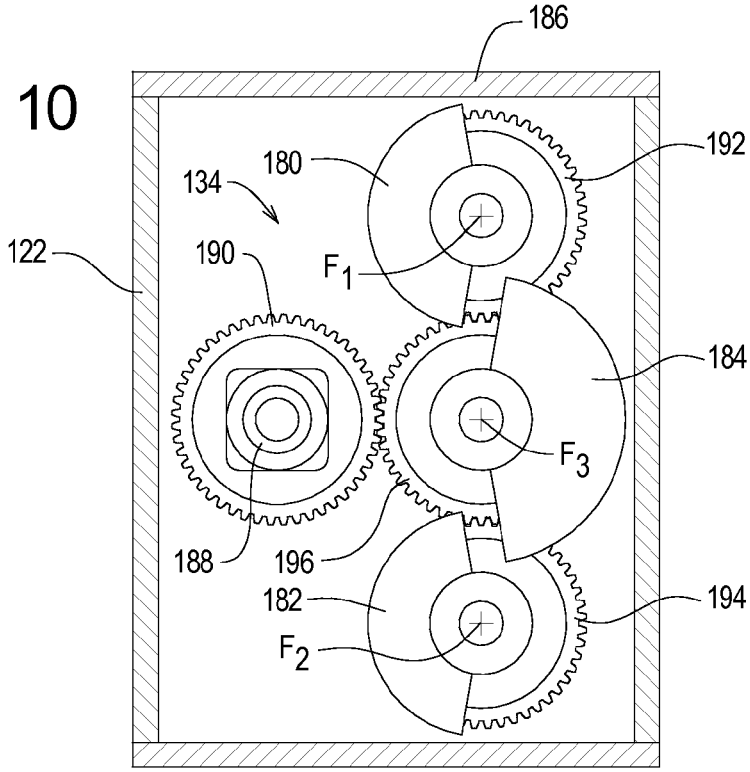
FIG. 10 is a side elevation, partial cut-away view depicting a vibration assembly of the driving assembly of FIG. 6.
Figure 11:
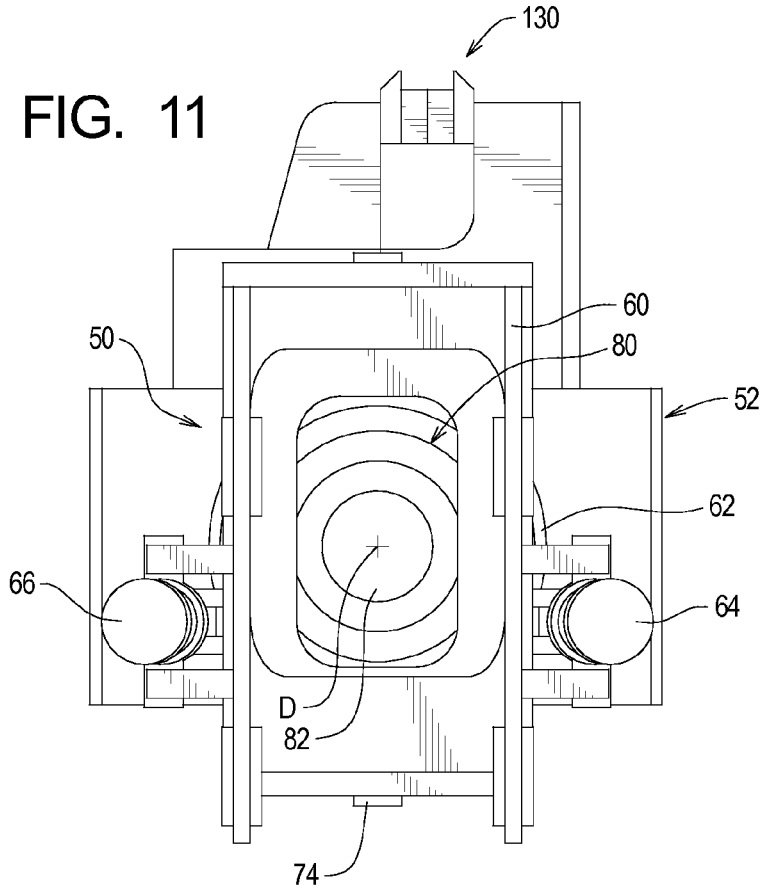
FIGS. 11 and 12 are top plan views illustrating a third axis of rotation of the pile handling system of FIG. 1.
Figure 12:
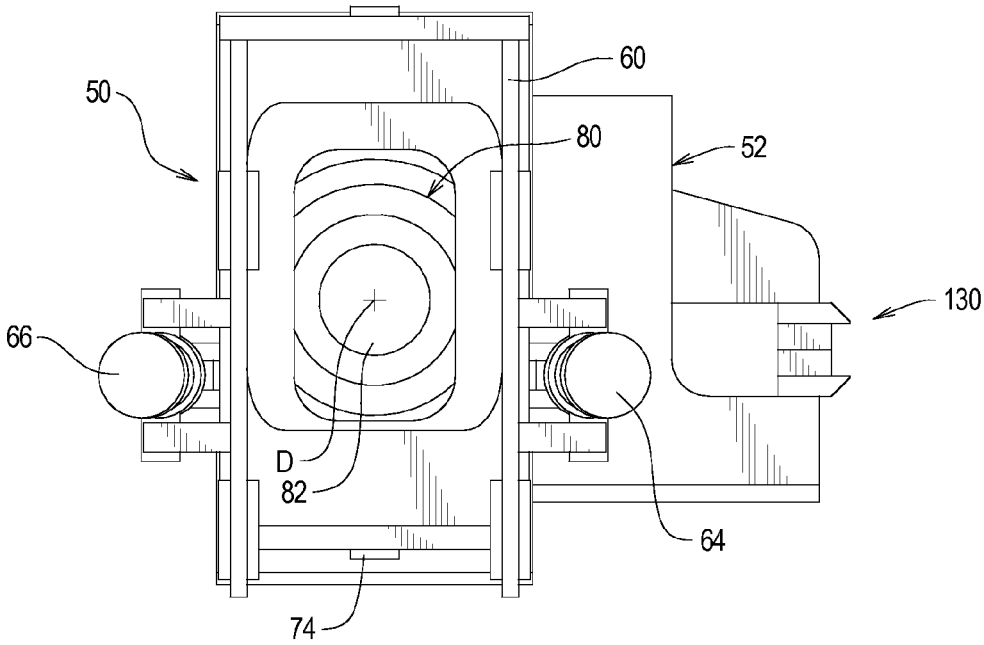

Referring now to FIGS. 6-7 and 10, the vibrational system 134 will now be described in further detail. As perhaps best shown in FIGS. 7, 8, and 10, the example vibrational system 134 comprises an upper eccentric member 180, a lower eccentric member 182, and a middle eccentric member 184. These eccentric members 180, 182, and 184 are secured relative to the secondary housing 122 for rotation about first, second, and third eccentric axes $G_1$, $G_2$, and $G_3$, respectively. The eccentric axes $G_1$, $G_2$, and $G_3$ are aligned along a vibro axis H. The mass of the upper and lower eccentric members 180 and 182 is substantially equal to that of the middle eccentric member 184. Accordingly, when the upper and lower eccentric members 180 and 182 are counter-rotated together relative to the middle eccentric member 184, lateral forces are cancelled and vertical forces are summed, yielding a vibratory force in both directions along the vibro axis H.

The vibrational system 134 is contained within a vibro housing 186 attached to or formed as part of the secondary housing 122. In addition, as shown in FIG. 10, the vibrational system 134 comprises a vibro drive 188, the output shaft of which is rigidly connected to a master drive gear 190. The upper eccentric member 180 and lower eccentric member 182 are rigidly connected to upper and lower slave gears 192 and 194, respectively. The middle eccentric member 184 is rigidly connected to a middle slave gear 196. The master drive gear 190 engages the middle slave gear 196 such that rotation of the vibro drive 188 causes rotation of the middle slave gear 196. The upper and lower slave gears 192 and 194 are in turn engaged with the middle slave gear 196 such that rotation of the middle slave gear is transmitted to the slave gears 192 and 194.

The vibro axis H is substantially aligned with the clamp plane $F_1$ such that the vibrational forces created by the vibrational system 134 are transmitted directly to the pile 22 to be driven. In addition, the vibro axis H is substantially parallel to and spaced a short distance from the third axis D about which the main assembly 32 is rotated.

The first and second clamp planes $F_1$ and $F_2$ are angled with respect to each other. In the example system 20, the clamp planes $F_1$ and $F_2$ are substantially orthogonal to each other as is apparent from an examination of the drawings. The first and second gripping locations $X_1$ and $X_2$ are spaced from each other in the first clamp plane F1, while the third gripping location Y is spaced from the first and second gripping locations $X_1$ and $X_2$ within the second clamp plane F2.

The relationship of the first and second clamp planes $F_1$ and $F_2$ and first, second, and third clamping locations $X_1$, $X_2$, and Y changes the character of the clamp assemblies 130 and 132 and allows the system 20 to be used as required by a particular task at hand. The first clamp assembly 130 is particularly suited to gripping a side of an H-beam type pile as depicted in FIGS. 1-5 but can also be used to pick sheet piles from a stack as shown in FIG. 15. The second clamp assembly is particularly suited to gripping an end of an H-beam type pile as depicted in FIG. 17 but can also be used to move piles around prior to driving as shown, for example, in FIG. 16.

During driving of a pile such as the example elongate pile 22 or sheet piles 28, in addition to the vibrational forces created by the vibrational system 134, the support system 30 applies a driving force (in either direction) to the pile 22 through the main assembly 32. The driving force is applied substantially along the third axis D as defined above. When the pile 22 is gripped by the support system 30, the pile axis A is substantially parallel to the third axis D and the vibro axis H and is spaced a short distance from these axes D and H. The pile handling system 20 thus applies both driving and vibratory forces along axes that are substantially aligned with the pile axis A, thereby minimizing bending moments on the pile 22 during insertion and extraction.

The pile driving system 20 thus may be used operates in either of first or second modes using the first and second clamp assemblies 130 and 132, respectively, to secure the secondary housing 122 to the pile 22. In addition, the pile driving system may be used in a third mode, in which the first clamp assembly is used to pick one or more sheet piles 28 from a stack or in a fourth mode to move piles 22 or 28 around prior to driving. The pile driving system 20 is thus a highly flexible device that can easily and efficiently accomplish a number of tasks related to the movement and driving of piles of different types.

From the foregoing, it should be clear that the present invention may be embodied in forms other than those described above. The above-described systems are therefore to be considered in all respects illustrative and not restrictive.

What is claimed is:

1. A pile driving system for driving a pile comprising:

a support system comprising an arm assembly;

a yoke member operatively attached to the arm assembly;

an arm actuator assembly operatively connected between the arm assembly and the yoke member such that actuation of the arm actuator assembly displaces the yoke member relative to the arm assembly;

a coupler mount operatively connected to the yoke member for rotation relative to the yoke member;

at least one lateral actuator assembly operatively connected between the yoke member and the coupler mount to rotate the coupler mount relative to the yoke member;

a coupler bearing assembly operatively connected to the coupler mount;

an engaging system comprising a primary housing and a secondary housing, where the primary housing is operatively connected to the coupler bearing assembly such that the engaging system rotates relative to the support system;

a rotation actuator for causing the engaging system to rotate relative to the support system;

a suspension system configured to resiliently oppose movement of the secondary housing within a limited range of movement relative to the primary housing;

a vibratory system rigidly connected to the secondary housing;

a first clamp assembly supported by the secondary housing, where the first clamp assembly comprises first and second grip members configured to define a first clamp plane, at least one pick member extending laterally relative to at least one of the grip members in a direction substantially parallel to the first clamp plane, where each pick member defines a tip portion; and a second clamp assembly supported by the secondary housing;

whereby the engaging system operates in a first mode in which the first clamp assembly rigidly connects the secondary housing to the pile; and a second mode in which the second clamp assembly rigidly connects the secondary housing to the pile;

a third mode in which the second clamp assembly rigidly connects the secondary housing to a side portion of the pile; and a fourth mode in which the tip portion of the at least one pick member engages at least one sheet pile of a substantially horizontal stack of sheet piles to remove the at least one sheet pile from the stack of sheet piles; and the pile driving system drives the pile in at least one of the first and second modes using at least one of a driving force generated by the support system, and a vibrational force generated by the vibratory system.

2. A pile driving system as recited in claim 1, in which:

the first clamp assembly is optimized to grip a side edge of the pile; and the second clamp assembly is optimized to grip an end of the pile.

3. A pile driving system as recited in claim 2, in which:

the first clamp assembly defines first and second clamp locations arranged in the first clamp plane;

the second clamp assembly defines a third clamp location arranged in a second clamp plane.

4. A pile driving system as recited in claim 3, in which the third clamp location is spaced from the first and second clamp locations.

5. A pile driving system as recited in claim 1, in which:

the first clamp assembly defines first and second clamp locations;

the second clamp assembly defines a third clamp location; and the third clamp location is spaced from the first and second clamp locations.

6. A pile driving system as recited in claim 1, in which the support system allows displacement of the engaging system.

7. A pile driving system as recited in claim 1, in which the first clamp assembly comprises a plurality of pick members, where at least one pick member of said plurality of pick members is fixed relative to the secondary housing and at least one pick member of said plurality of pick members is movable relative to the secondary housing.

8. A pile driving system as recited in claim 1, in which the suspension system comprises:

a plurality of mounting locations; and a plurality of resilient members extending between the primary and secondary housings at least some of the mounting locations.

9. A method of driving a pile comprising the steps of:

providing an engaging system comprising a primary housing and a secondary housing;

operatively connecting a yoke member to an arm assembly of a support system;

operatively connecting an arm actuator assembly between the arm assembly and the yoke member such that actuation of the arm actuator assembly displaces the yoke member relative to the arm member;

operatively connecting a coupler mount to the yoke member;

operatively connecting at least one lateral actuator assembly between the yoke member and the coupler mount to rotate the coupler mount relative to the yoke member;

operatively connecting a coupler bearing assembly to the primary housing and the coupler mount, where the coupler bearing assembly allows rotation of the engaging system about a rotation axis relative to the support system;

arranging a rotation actuator to cause the engaging system to rotate relative to the support system about the rotation axis;

configuring a suspension system to resiliently oppose movement of the secondary housing within a limited range of movement relative to the primary housing;

rigidly connecting a vibratory system to the secondary housing;

supporting a first clamp assembly from the secondary housing, where a first clamp member comprises first and second grip members configured to define a clamp plane;

supporting at least one pick member such that the at least one pick member extends laterally relative to at least one of the first and second grip members in a direction substantially parallel to the first clamp plane, where each pick member defines a tip portion;

supporting a second clamp assembly from the secondary housing;

operating the first clamp assembly in a first mode to rigidly connect the secondary housing to a side of the pile; and operating the second clamp assembly in a second mode to rigidly connect the secondary housing to an end of the pile;

operating the second clamp assembly in a third mode to rigidly connect the secondary housing to the side of the pile;

operating the second clamp assembly in a fourth mode in which the tip portion of the at least one pick member engages at least one sheet pile of a substantially horizontal stack of sheet piles to remove the at least one sheet pile from the stack of sheet piles; and driving the pile in at least one of the first and second modes using at least one of a driving force generated by the support system, and a vibrational force generated by the vibratory system.

10. A method as recited in claim 9, in which:

the second clamp assembly defines a second clamp plane; and the first and second clamp planes are substantially perpendicular to each other.

11. A method as recited in claim 9, in which:

the first clamp assembly defines first and second clamp locations; and the second clamp assembly defines a third clamp location;

further comprising the step of spacing the third clamp location from the first and second clamp locations.

12. A method as recited in claim 11, in which:

the second clamp assembly defines a second clamp plane;

further comprising the step of arranging the first and second clamp assemblies such that the first and second clamp planes are substantially perpendicular to each other.

13. A method as recited in claim 9, further comprising the steps of:

providing the first clamp assembly with a first pick member that is fixed relative to the secondary housing; and providing the first clamp assembly with a second pick member that is movable relative to the secondary housing.

14. A method as recited in claim 9, in which the step of providing the suspension system comprises the steps of:

defining a plurality of mounting locations; and connecting at least one resilient member between the primary and secondary housings at least one of the mounting locations.

* * * * *